US006098241A

United States Patent [19]

Wood

[11] Patent Number: 6,098,241

[45] Date of Patent: Aug. 8, 2000

[54] ACCESSORY HOLDER FOR VACUUM CLEANER

[75] Inventor: Steve Wood, Cadillac, Mich.

[73] Assignee: Rexair, Inc., Troy, Mich.

[21] Appl. No.: 09/360,604

[22] Filed: Jul. 26, 1999

Related U.S. Application Data

[63] Continuation of application No. 09/021,610, Feb. 10, 1998, Pat. No. 5,943,731.

[51] Int. Cl.[7] ..... A47L 9/00

[52] U.S. Cl. ..... 15/323; 15/327.1

[58] Field of Search ..... 15/323, 327.1, 15/327.2, 327.6

[56] References Cited

U.S. PATENT DOCUMENTS

| | | | |
|---|---|---|---|
| D. 294,755 | 3/1988 | Lackner et al. . | |
| D. 294,756 | 3/1988 | Fonville . | |
| D. 295,334 | 4/1988 | Fonville . | |
| D. 295,910 | 5/1988 | Hill . | |
| 2,450,172 | 9/1948 | Stoner | 15/323 |
| 2,603,816 | 7/1952 | Macfarland | 15/323 X |
| 2,779,047 | 1/1957 | Osborn | 15/323 |
| 2,825,087 | 3/1958 | Meyerhoefer | 15/323 |
| 2,920,337 | 1/1960 | Smith | 15/323 |
| 2,935,760 | 5/1960 | Martinec . | |
| 3,085,279 | 4/1963 | Meyerhoefer . | |
| 3,778,863 | 12/1973 | Westergren et al. . | |
| 3,869,265 | 3/1975 | Wolter et al. | 15/323 X |
| 3,872,538 | 3/1975 | Crouser . | |
| 3,955,237 | 5/1976 | Chateauneuf et al. . | |
| 4,554,700 | 11/1985 | Lyman | 15/323 |
| 4,563,789 | 1/1986 | Berfield . | |
| 4,653,638 | 3/1987 | Lackner . | |
| 4,888,849 | 12/1989 | Hult et al. | 15/323 X |
| 5,071,012 | 12/1991 | Jailor . | |
| 5,125,127 | 6/1992 | Bach et al. . | |
| 5,142,731 | 9/1992 | Resch . | |
| 5,303,447 | 4/1994 | McKnight . | |
| 5,307,537 | 5/1994 | Essex et al. . | |
| 5,313,686 | 5/1994 | Berfield . | |
| 5,373,606 | 12/1994 | Bosyj et al. . | |
| 5,528,794 | 6/1996 | Tomasiak | 15/323 |
| 5,713,103 | 2/1998 | Keebler et al. | 15/323 |
| 5,732,438 | 3/1998 | Tuvin et al. | 15/323 |
| 5,826,299 | 10/1998 | Kim . | |
| 5,850,666 | 12/1998 | Farone et al. . | |
| 5,924,165 | 7/1999 | Gierer et al. | 15/327.2 X |

*Primary Examiner*—Chris K. Moore
*Attorney, Agent, or Firm*—Howard & Howard

[57] ABSTRACT

An accessory holder for a vacuum cleaner having a base member for supporting a plurality of vacuum accessories. The base member has a pair of arms for attaching the holder to a support structure on the vacuum cleaner. The arms include a tapered wedge projecting from the base member for intermeshing with a tapered channel in the support structure to provide a frictional retaining attachment of the base member to the support structure. The holder further includes a cradle portion extending from the base member for selectively engaging a portion of the vacuum cleaner wand to detachably secure the holder to the wand.

30 Claims, 4 Drawing Sheets

ACCESSORY HOLDER FOR VACUUM CLEANER

RELATED APPLICATION

This is a continuation of application Ser. No. 09/021,610 filed on Feb. 10, 1998 now U.S. Pat. No. 5,943,731, issued Aug. 31, 1999.

BACKGROUND OF THE INVENTION

1. Field of the Invention

The subject invention relates to an accessory holder for a vacuum cleaner apparatus, and more particularly, to an accessory holder having a friction lock connection between the holder and the vacuum.

2. Description of the Related Art

Vacuum cleaner apparatuses commonly include holders for storing accessories for usage with the vacuum such as brushes, crevice tools, extension wands, end fitting, etc.

Often times, the holders are permanently secured to the vacuum and cannot be easily removed, such as disclosed in U.S. Pat. No. 2,935,760 to Martinec, issued May 10, 1960.

Additionally, other holders are of the type which are portable and detachable holders which are independent of the vacuum cleaner. However, these holders cannot be interchangeably attached and detached between the vacuum cleaner housing or base and the vacuum wand or handle to provide easy access to the accessories during use. Such holders are exemplified in U.S. Pat. No. 4,653,638 to Lackner et al., issued Mar. 31, 1987.

It is desirable to provide a detachable accessory holder for a vacuum cleaner apparatus which may be securely retained to the vacuum, yet easily removable for attachment to the wand, hose or handle of the vacuum during use to provide simple access to the accessory tools.

SUMMARY OF THE INVENTION

The subject invention relates to an accessory holder for a vacuum cleaner having a base member for supporting at least one vacuum accessory, said base member having at least one releasable attachment member for attaching the holder to a support structure on the vacuum cleaner. The attachment member includes a tapered wedge projecting from the base member for intermeshing with a tapered channel in said support structure to provide a frictional retaining attachment of the base member to the support structure.

The subject invention further includes a cradle portion extending from the base member for selectively engaging a portion of the vacuum cleaner wand to detachably secure the holder to the wand.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
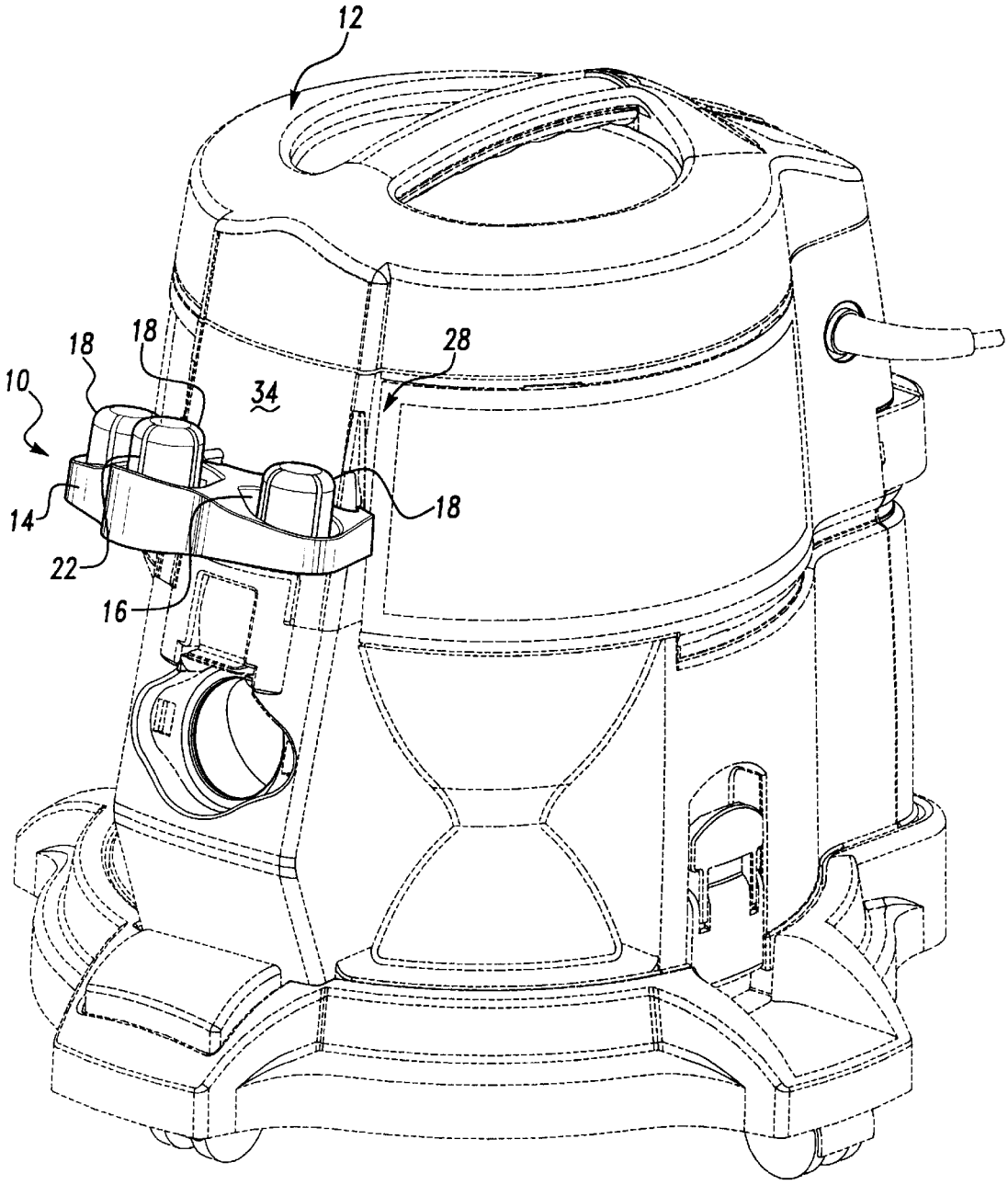
FIG. 1 is a perspective view of a vacuum cleaner apparatus supporting an accessory holder according to the subject invention.
Figure 2:
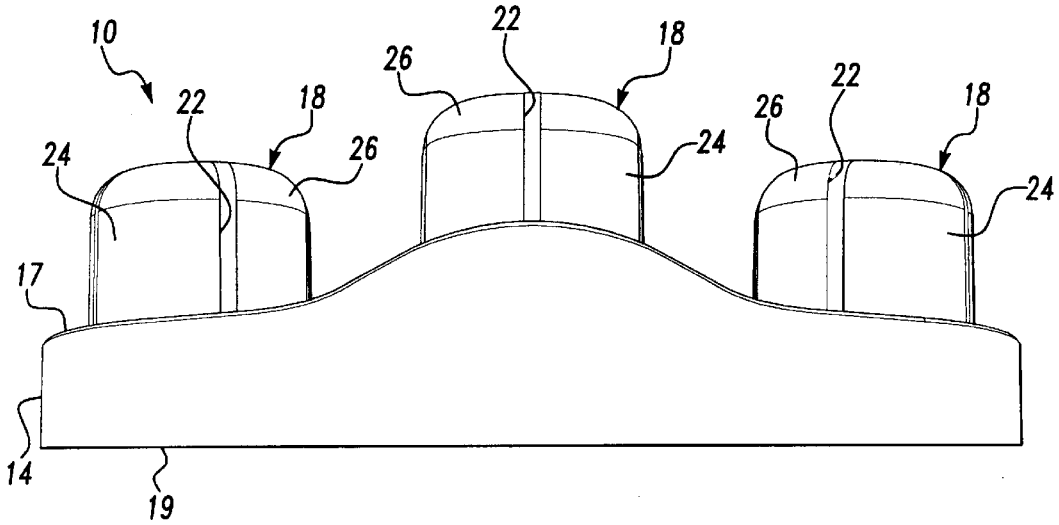
FIG. 2 is a front view of the accessory holder according to the subject invention.
Figure 3:
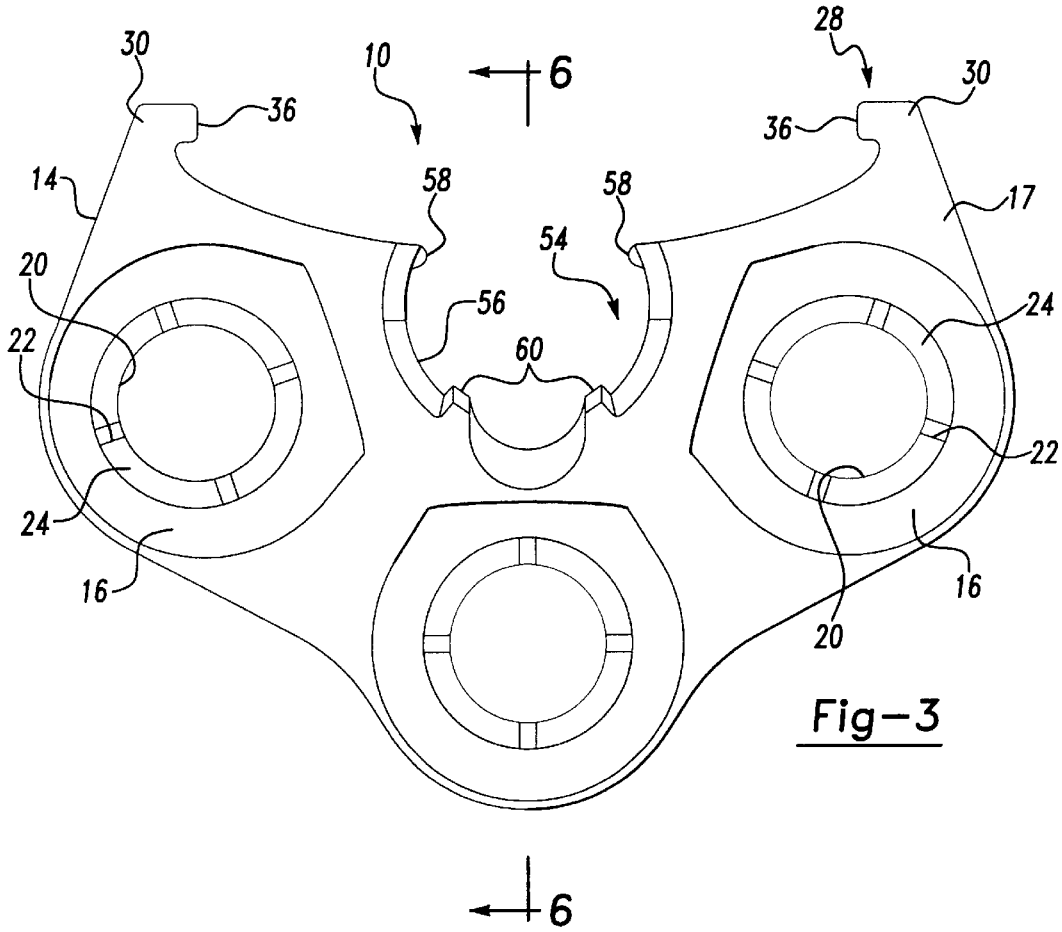
FIG. 3 is a top view of the accessory holder.
Figure 4:
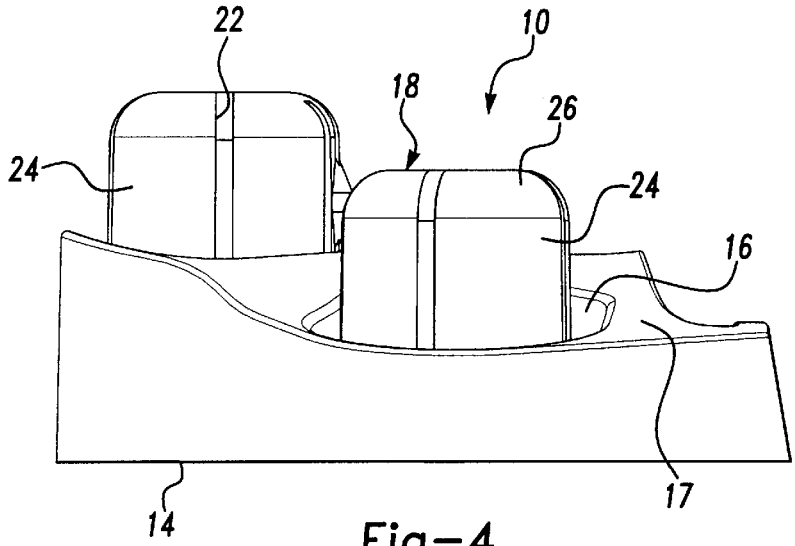
FIG. 4 is a side view of the accessory holder.
Figure 5:
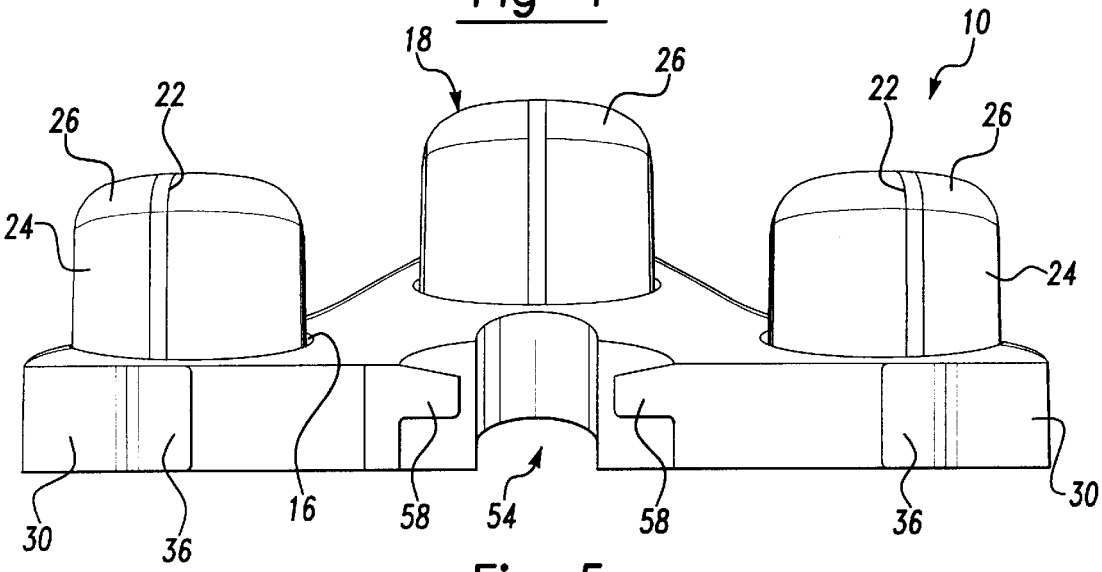
FIG. 5 is a rear view of the accessory holder.

Referring to the Figures, wherein like numerals indicate like or corresponding parts throughout the several views, FIGS. 1–5 disclose an accessory holder 10 for attachment to a vacuum cleaner apparatus 12. The accessory holder 10 includes a base member 14 for support of a plurality of vacuum accessories, such as a brush, floor and crevice cleaning tool as shown at 15 in FIG. 11. The holder is preferably made of an organic polymeric material and molded as a unitary piece. The base member 14 includes an upper surface 17 and a lower surface 19 and houses a plurality of recessed cavities 16 having a generally cylindrical configuration for receiving a tubular wand attachment part of each of the accessory tools in the base member 14. A bulbous projection 18 is fixedly secured and supported by the base member 14 in the center of each of the cavities 16 and projects upwardly from the base 14 above the perimeter of the cavities 16. The projections 18 are also generally cylindrical and have a circumferential diameter less than the diameter of the cavities 16 so that a space is created therebetween to receive the tubular portion of the accessory tool 15. Each of the bulbous projections 18 is a hollow tube extending from the base member 14 in the cavity 16 to an open distal end 20. Each projection further includes a plurality of longitudinal slots 22 extending from the open distal end 20 to the base 14 which divides the projection 18 into quarter sections 24. Each quarter section 24 has an inwardly curved tip 26 adjacent the open distal end. The curved tips 26 of the projections provide a smooth guideway for aligning and receiving the tubular portion of the accessory tools 15. Further, the quarter sections 24 provide the projections 18 with flexibility about its diameter to accommodate varying sized tubular portions of the tools 15 and also resiliency or elasticity to provide enough friction to retain the tool 15 on the projection 18.

Figure 6:
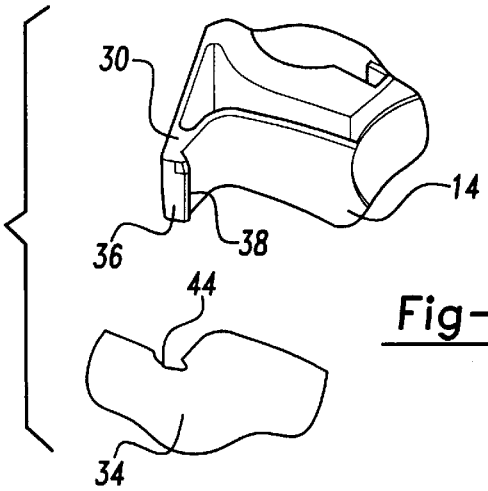
FIG. 6 is a partially broken, top exploded view of the attachment member of the holder and the support structure of the vacuum.
Figure 7:
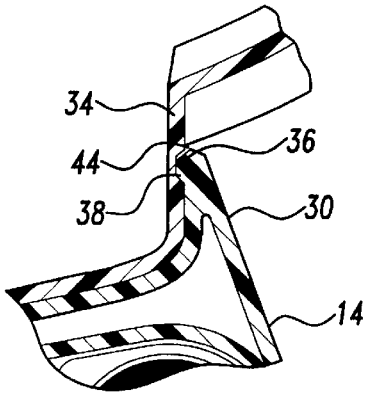
FIG. 7 is a partially broken, cross-sectional view of the attachment member connected to the support structure.
Figure 8:
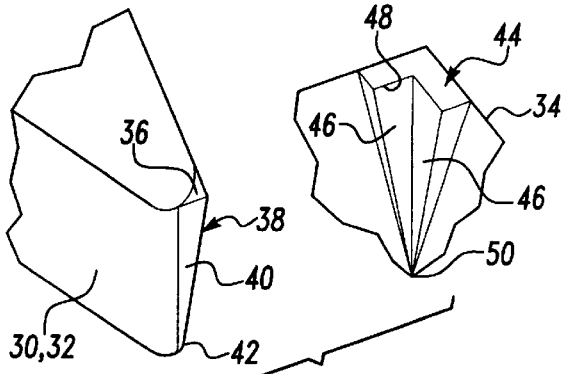
FIG. 8 is a partially broken, exploded view of the tapered wedge and channel.

Referring to FIGS. 6–8, the base member 14 further includes at least one releasable attachment member 28 for attaching the holder 10 to the vacuum 12. The releasable attachment member 28 includes a pair of spaced apart arms 30,32 projecting outwardly from the side of the base member 14, perpendicular to the projections 18 toward a support structure 34 on the vacuum 12. Each arm 30, 32 includes a tab portion 36 projecting inwardly from the corresponding arm 30 in facing relation, that is, one tab 36 projects toward the opposing tab 36. Each tab 36 includes a tapered wedge 38 extending the length of the tab 36 and tapering in width from the top of the tab 36 at the upper surface 17 of the base member 14 to the bottom of the tab 36 at the lower surface 19 of the base member 14. The tapered wedge 38 comprises a plurality of angled surfaces 40 which matingly abut each adjoining surface to decrease the width dimension of the wedge 38 from the top to bottom of the tab 36 until the wedge reaches a point 42 along its bottom.

The support structure 34 on the vacuum cleaner 12 includes a pair of spaced apart tapered channels 44 for receiving the respective tabs 36 therein and providing a frictional retaining attachment of the base member 14 to the support structure 34. Each of the tapered channels 44 similarly include a plurality of angle surfaces 46 which restrict or decrease the width dimension of the channels 44 along the length from the open top 48 of the channel 44 to the closed point bottom 50 of the channel 44.

In operation, to attach the accessory holder 10 to the support structure 34 of the vacuum, the tabs 36 are aligned with the support structure 34 until the tapered wedged 38 are immediately above and aligned with the open top 48 of each tapered channel 44. As the holder 10 is lower into engagement with the support structure 34, the tapered wedges 38 slidably engage the corresponding tapered channels 44. The angle surfaces 40 of the wedges 38 intermesh or press into the angle surfaces 46 of the channels 44 until the holder 10 is frictionally retained against the support structure 34.

Further, as the weight of the accessory tools 15 is added to the holder 10, the tabs 36 and wedges 38 extend further into the channels 44 to provide a tighter frictional fit. Additionally, use and vibrations of the vacuum allow further enhances the frictional fit to prevent movement and vibrational noise from the holder 10.

Figure 9:
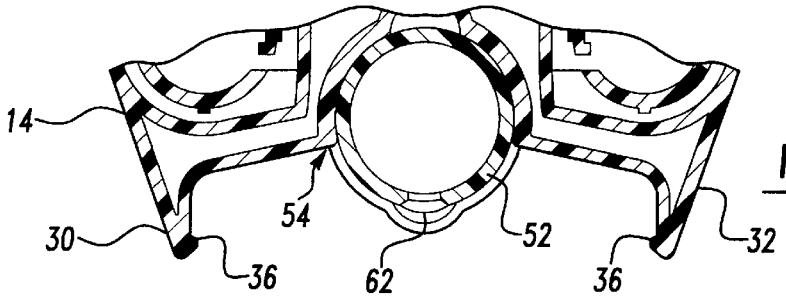
FIG. 9 is a partially broken, cross-sectional top view of the holder attached to a vacuum cleaner wand.
Figure 10:
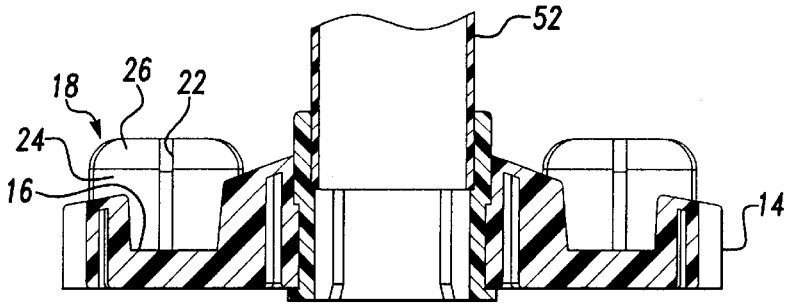
FIG. 10 is a partially broken, cross-sectional side view of FIG. 9.
Figure 11:
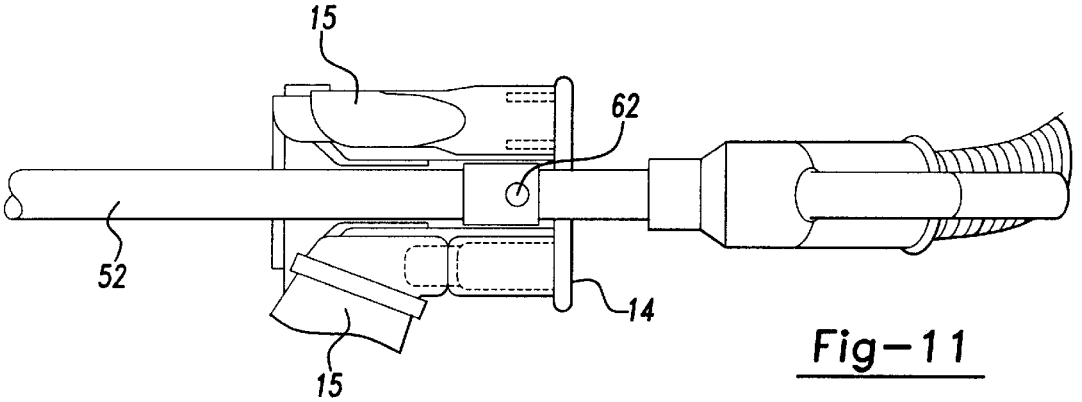
FIG. 11 is an environmental view of the accessory holder attached to the vacuum cleaner wand.

Referring now to FIGS. 3 and 9–11, the holder 10 is shown for use as an attachment onto a wand or handle 52 of the vacuum. The holder 10 includes a cradle portion 54 extending from the base 14 and between the spaced apart arms 30,32. The cradle portion 54 includes a generally U-shaped, cylindrical opening 56 having a pair of detent nubs 58 at opposing ends of the U-shaped opening 56. A second pair of nubs 60 are positioned along the crest of the U-shaped opening 56. The wand 52 includes a spring loaded push button 62 for attachment to a variety of devices or extensions. The holder 10 may be attached to the wand 52 by snapping the cradle portion 54 around the tubular portion of the wand 52, as shown in FIGS. 9–11, with the tubular portion received in the U-shaped opening 56 until the detent nubs 58 grab and retain the wand 52 in the cradle 54. The push button is aligned between the nubs 60 and provides a biasing force of the tubular portion of the wand 52 against the detent nubs 58 to retain the holder 10 around the wand 52. Once attached, the accessory holder 10 is readily accessible to the user for changing of tools 15 as desired.

The invention has been described in an illustrative manner, and it is to be understood that the terminology which has been used is intended to be in the nature of words of description rather than of limitation.

Obviously, many modifications and variations of the present invention are possible in light of the above-teachings. It is, therefore, to be understood that within the scope of the appended claims, the invention may be practiced otherwise than as specifically described.

What is claimed is:

1. An accessory tool holder for a vacuum cleaner having a housing comprising:

a base member for supporting at least one vacuum accessory tool; and at least one releasable attachment member for selectively attaching said base member to the housing on the vacuum cleaner, said attachment member comprising a first portion projecting from said base member for interacting with a second portion disposed on the housing to provide a frictional retaining attachment of said base member to the housing wherein said first portion of said attachment member includes a pair of spaced apart arms projecting outwardly from opposing ends of one side of said base member and said second portion includes a pair of substantially vertically extending channels for receiving said arms.

2. An accessory tool holder as set forth in claim 1 wherein said base member includes at least one recessed cavity for receiving said vacuum accessory tool.

3. An accessory tool holder as set forth in claim 2 including at least one projection fixedly secured to said base member and extending outwardly from said recessed cavity.

4. An accessory tool holder for a vacuum cleaner having a housing comprising:

a base member for supporting at least one vacuum accessory tool and including at least one recessed cavity for receiving said vacuum accessory tool;

at least one releasable attachment member for selectively attaching said base member to the housing on the vacuum cleaner, said attachment member comprising a first portion projecting from said base member for interacting with a second portion disposed on the housing to provide a frictional retaining attachment of said base member to the housing; and at least one projection fixedly secured to said base member and extending outwardly from said recessed cavity wherein said cavity is defined by a first diameter and said projection is formed as a hollow tube defined by a second diameter with said tube extending from said base member to an open distal end, said second diameter being less than said first diameter to form a gap between said cavity and said projection for receiving a portion of said accessory.

5. An accessory tool holder as set forth in claim 4 wherein said projection includes a plurality of longitudinal slots extending from said open distal end to said base member, said slots being spaced circumferentially about said projection to form a plurality of resilient sections between adjacent slots.

6. An accessory tool holder as set forth in claim 5 wherein each of said sections includes an inwardly curved tip adjacent to said open distal end for providing a guideway for said accessory tool as said accessory tool is installed in the holder.

7. An accessory tool holder as set forth in claim 1 wherein each of said arms includes an extension projecting inwardly toward said opposing arm with said extensions being in a facing relationship to each other.

8. An accessory tool holder as set forth in claim 7 wherein said base member includes a top surface and a bottom surface and said extensions include a tapered wedge extending along the length of said extension, said wedge tapering in width from said top surface to said bottom surface such that the width at said top surface is greater than the width at said bottom surface.

9. An accessory tool holder as set forth in claim 8 wherein said channels are tapered for receiving said extensions.

10. An accessory tool holder for a vacuum cleaner having a housing comprising:

a base member for supporting at least one vacuum accessory tool; and at least one releasable attachment member for selectively attaching said base member to the housing on the vacuum cleaner, said attachment member comprising a first portion projecting from said base member for interacting with a second portion disposed on the housing to provide a frictional retaining attachment of said base member to the housing wherein said at least one releasable attachment member is comprised of a first releasable attachment member for selectively securing said base member to the support structure of the vacuum cleaner and a second releasable attachment member for alternatively engaging a portion of a vacuum cleaner wand to detachably secure said base member to said portion of the wand.

11. An accessory tool holder as set forth in claim 10 wherein said first releasable attachment member includes a pair of spaced apart arms projecting outwardly from opposing sides of said base member and said second releasable attachment member is formed as a cradle portion defined by an opening extending inwardly toward the center of said base member, said cradle portion being positioned between said arms.

12. An accessory tool holder as set forth in claim 11 wherein said opening is generally U-shaped having first and second ends interconnected by a curved crest and wherein said cradle portion includes a first pair of detents with one of said detents positioned at said first end of said opening and the other of said detents positioned at said second end of said opening, said first pair of detents for retaining said base member on the wand.

13. An accessory tool holder as set forth in claim 12 wherein the wand includes a resilient button for securing said accessory tool to the wand and wherein said cradle portion includes a second pair of detents positioned along said crest, said button being aligned between said second pair of detents to provide a biasing force of the wand against said first pair of detents to frictionally retain said base member to the wand.

14. An accessory tool holder for a vacuum cleaner having a housing and a cleaning wand comprising:

a base member for supporting at least one vacuum accessory tool;

a first releasable attachment member for selectively attaching said base member to the housing on the vacuum cleaner for support thereon; and a second releasable attachment member for selectively and independently attaching said base member to the cleaning wand for support thereon.

15. An accessory tool holder as set forth in claim 14 wherein said first releasable attachment member includes a pair of spaced apart arms projecting outwardly from opposing sides of said base member.

16. An accessory holder as set forth in claim 15 wherein said second releasable attachment member is formed as a cradle portion defined by an opening extending inwardly toward a center of said base member, said cradle portion being positioned between said arms.

17. An accessory tool holder as set forth in claim 15 wherein each of said arms includes tapered wedges for engaging corresponding tapered channels on the housing to provide a frictional retaining attachment of said base member to the housing.

18. An accessory tool holder as set forth in claim 14 wherein said second releasable attachment member is formed as a cradle portion defined by an opening extending inwardly toward a center of said base member.

19. An accessory tool holder as set forth in claim 18 wherein said cradle portion includes a first pair of detents extending into said opening for gripping said base member to a tubular portion of the wand.

20. An accessory tool holder as set forth in claim 19 wherein the wand includes a resilient button for securing said accessory tool to the wand and wherein said cradle portion includes a second pair of detents extending into said opening such that said button is aligned between said second pair of detents to provide a biasing force of the wand against said first pair of detents to frictionally retain said base member to the wand.

21. An accessory holder as set forth in claim 14 wherein said at least one vacuum accessory tool is comprised of a plurality of vacuum accessory tools and said base member includes a plurality of recessed cavities, each of said cavities for receiving one of said vacuum accessory tools.

22. An accessory tool holder as set forth in claim 21 including a plurality of projections fixedly secured to said base member with one projection extending outwardly from each of said recessed cavities such that a gap is formed between said cavities and said projections for receiving a portion of each of said vacuum accessory tools.

23. An accessory tool holder as set forth in claim 22 wherein said projections include a plurality of longitudinal slots spaced circumferentially about said projections to form a plurality of resilient sections between adjacent slots, each of said sections extending to an inwardly curved distal tip for providing a guideway for each of said vacuum accessory tools as each of said accessory tools is installed in the holder.

24. A vacuum cleaner assembly comprising:

a housing including a first engagement portion;

a cleaning wand connectable to said housing and including a second engagement portion; and an accessory holder for supporting at least one vacuum accessory tool, said holder including a base member and a plurality of releasable attachment members for selectively engaging said first engagement portion to secure said holder to said housing independently from said wand and for selectively engaging said second engagement portion to secure said holder to said wand independently from said housing.

25. An assembly as set forth in claim 24 wherein said plurality of releasable attachment members is comprised of a first releasable attachment member for selectively securing said base member to said first engagement portion and a second releasable attachment member for selectively securing said base member to said second engagement portion.

26. An assembly as set forth in claim 25 wherein said first releasable attachment member is comprised of a pair of spaced apart arms projecting outwardly from opposing sides of said base member, each of said arms having a tapered wedge, and wherein said first engagement portion is comprised of a pair of tapered channels, said wedges for engaging said channels to provide a frictional retaining attachment of said base member to said housing.

27. An assembly as set forth in claim 26 wherein said second releasable attachment member is comprised of a cradle portion defined by an opening extending inwardly toward a center of said base member and including a first pair of detents extending into said opening for gripping said second engagement portion to attach said base member to said wand.

28. An assembly as set forth in claim 27 wherein said wand includes a resilient connector for securing said accessory tool to said wand and wherein said cradle portion includes a second pair of detents extending into said opening such that said connector is aligned between said second pair of detents to provide a biasing force of said wand against said first pair of detents to frictionally retain said base member to said wand.

29. An assembly as set forth in claim 24 wherein said at least one vacuum accessory tool is comprised of a plurality of vacuum accessory tools and said base member includes a plurality of recessed cavities for receiving said vacuum accessory tools.

30. An assembly as set forth in claim 29 including a plurality of projections fixedly secured to said base member with one projection extending outwardly from each of said recessed cavities such that a gap is formed between said cavities and said projections for receiving a portion of each of said accessory tools.

* * * * *